United States Patent [19]

Juergens

[11] 4,124,184

[45] Nov. 7, 1978

[54] DOOR CATCH

[75] Inventor: Alfred R. Juergens, Muskegon, Mich.

[73] Assignee: Fleet Engineers, Inc., Muskegon Heights, Mich.

[21] Appl. No.: 813,785

[22] Filed: Jul. 8, 1977

[51] Int. Cl.[2] ..... B65D 45/06; E05C 5/00; E05C 13/02

[52] U.S. Cl. ..... 248/66; 292/241; 292/DIG. 49

[58] Field of Search ..... 292/65, 66, 113, 114, 292/241, 247, 252, 256, 256.5, 256.69, 257, DIG. 31, DIG. 49

[56] References Cited

U.S. PATENT DOCUMENTS

| | | | |
|---|---|---|---|
| 1,338,219 | 4/1920 | Dutcher | 292/66 UX |
| 1,450,365 | 4/1923 | Gray | 292/66 |
| 2,186,795 | 1/1940 | Anderson | 292/DIG. 49 |
| 2,703,431 | 3/1955 | Tatom | 292/DIG. 31 |
| 3,478,547 | 11/1969 | Constable | 292/DIG. 49 |
| 3,998,481 | 12/1976 | Anthone | 292/66 X |

FOREIGN PATENT DOCUMENTS

| | | | |
|---|---|---|---|
| 1,222,501 | 6/1960 | France | 292/113 |

*Primary Examiner*—J. Franklin Foss
*Attorney, Agent, or Firm*—McGarry & Waters

[57] ABSTRACT

A door catch including a housing mounted on a door, a lever arm pivotably mounted to the housing, a shank portion pivotably mounted to a midportion of the lever arm, the shank portion extending beyond the edge of the housing and adapted to fit within a keeper mounted adjacent a door. The lever arm and shank are movable between a closed and open position. The lever arm is spring biased to the open position. A rod extends through the shank portion and fits through slots in two flange portions of the housing. A latch is pivotably mounted on the rod and extends through aligned slots in both the shank portion and lever arm. The latch is spring biased to engage the lever arm adjacent the slot therethrough. The latch is movable to a releasing position whereby the lever arm and shank move to an open position and the shank disengages from the keeper.

15 Claims, 6 Drawing Figures

DOOR CATCH

BACKGROUND OF THE INVENTION

Field of the Invention

This invention relates to door catches and more particularly to a door catch having a shank pivotably mounted to a lever arm and adapted to engage a keeper.

State of the Prior Art

Refrigerator trailers have been subject to more usage and longer hauls. Such conditions render vent doors a necessity on the trailer. The catch on the vent door must be capable of being opened from a distance and be able to close automatically upon the closing of the door. The catch must also be able to exert an opening force on the door sufficient to break any frost seal which has formed around the edges of the door.

One such refrigerator lock is disclosed in U.S. Pat. No. 3,240,523 issued to Heimann on Mar. 16, 1966. Heimann discloses a door lock having a housing mounted on the door and a keeper mounted adjacent the door. A rigid handle having a first portion which engages the keeper and a second portion which engages a latch is pivotably mounted on the housing and adapted to move from a locking position to a released position The latch is spring biased to engage the handle portion of the handle. The handle is spring biased to a released position so that when the latch disengages the handle, the vent door is opened.

Another device adapted to be used on refrigerator vent doors is manufactured by Penz Tool and Manufacturing Company in Mishawaka, Indiana. The Penz Tool catch, catalogued as 10-1200-S.S., has a tongue portion pivotably mounted to a handle. The tongue engages a keeper which, when in the open position, abuts against a striker plate to force open the vent door. The handle is pivotably mounted onto two parallel flanges which are transverse to the plate of the door. The flanges have slots. The tongue portion has a roller pin extending therethrough which engages the slot. A spring resilient latch fits through a slot in the handle. The latch is mounted on an axle which extends between the two flanges of the housing. The latch is biased to a latching position and the handle is biased to an open position.

Today's vent doors have seals which give resistance to the door when the door is being fully closed. Such seals are often rubber gaskets lining the door entrance. A door catch must be able to be self-closing when the vent door is shoved closed and also be able to be manually latched. The latch must not prematurely obtain a closed position before the door is closed against the resistance of the seals. The latch must also be economically manufactured.

SUMMARY OF THE INVENTION

According to the invention, a door catch device includes a housing mounted on a door. A lever arm is pivotably mounted to the housing for movement between a first and second position. The lever arm is biased to the second position. A shank is pivotably mounted to the lever at a distance from the pivotable mounting of the lever arm to the housing. A guide means connected to the shank guides the shank between a first and second position. The shank is engaged by the keeper when in the first position and disengaged from the keeper when in the second position.

Further according to the invention, a latch is mounted on the shank for engagement with the lever when the shank and lever are in their respective first position and for retaining the shank and lever in the first position against the biasing force of the biasing means. The latch is capable of disengagement from the lever to allow the biasing means to move the lever arm and shank to their second positions.

Preferably, the latch is resiliently mounted on the shank and biased to engage the lever arm when in the first position.

In one embodiment, the latch is mounted on the guide means. The guide means has a portion mounted on the shank. Preferably, this portion is a cylindroid pin. The cylindroid pin extends through slots in the housing. The cylindroid pin is movable between the first and second positions in the slot which corresponds to the first and second positions of the shank and lever arm.

In a specific embodiment, the housing has two flanges transverse to the plane defined by the door. The slots extend through the flanges.

Further according to the invention, guide means include an arcuate track means defining an arc lying in the plane transverse to the plane defined by the door. The arcuate track has a parallel portion with respect to the door and a transverse portion. A track insert means is mounted to the shank for movement in the arcuate track means when the shank is moved between its first and second positions. The track insert means engages the transverse portion of the arcuate track when the shank and lever are in their first position and the track insert engages the parallel section of the arcuate track when the shank and lever are in their second position. Preferably, the arcuate track means consists of slots in the transverse flanges of the housing wherein the slots have an outer arcuate edge. The track insert is preferably the cylindroid pin mounted on the shank and extending through the slots.

Preferably, the slots have an inner edge which define an angle between 20° and 40° with respect to the plate defined by the door and sloped to converge with the door toward the keeper.

It is desirable that the latch mounted on the roller pin extend through a slot in the shank and an aligned slot through the lever arm.

It is also desirable that the latch has a camming means for automatically engaging the lever arm when the lever arm is moved from the second to first position. It is desirable that the latch has limited movement for maintaining proper alignment with both slots in the shank and lever arm.

In one embodiment, a striker plate is positioned between the door and keeper for engagement with a camming surface on the shank for automatically moving the shank to its first position as the door is closed.

DETAILED DESCRIPTION OF THE PREFERRED EMBODIMENT

Figure 1:
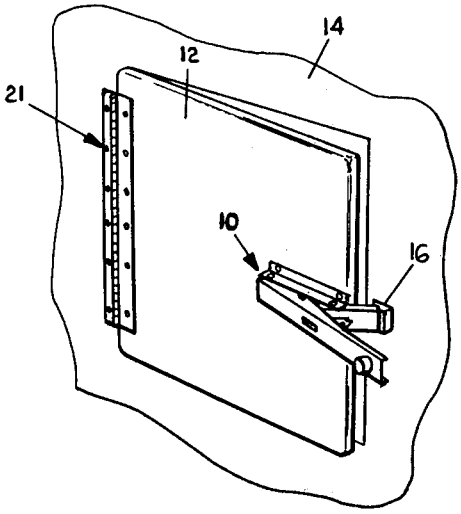
FIG. 1 is a perspective view of the door catch assembly mounted on a vent door of a refrigerated truck trailer.
Figure 2:
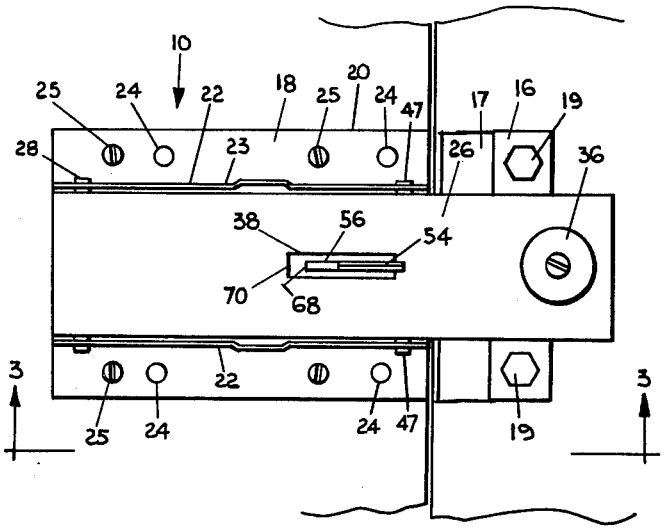
FIG. 2 is a front elevational view of the door catch assembly shown in FIG. 1 in the closed position.
Figure 3:
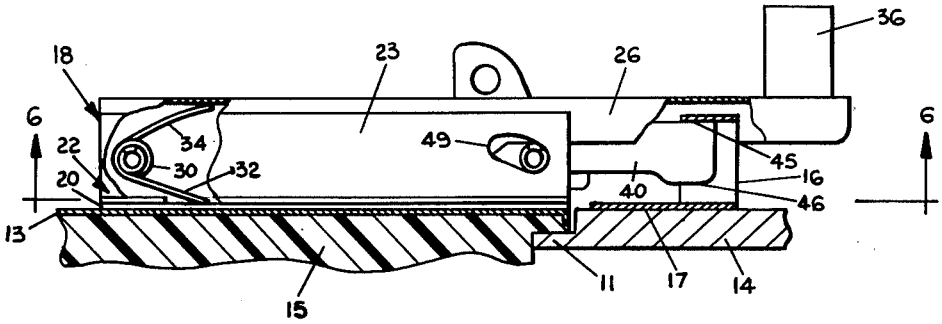
FIG. 3 is a side elevational partially broken away view of the door catch assembly taken along the lines 3—3 of FIG. 2.

Referring to the drawings, particularly FIG. 1, a door catch assembly 10 is mounted on a vent door 12. The vent door 12 is pivotably mounted in an opening in a wall 14 of a refrigerated trailer compartment of a truck (not shown) through conventional hinges 21. As shown in FIG. 3, the door 12 has a metallic cover 13 and a resilient synthetic resin insulation 15. The insulation abuts a sealing surface 11 of the wall 14 to create a seal between the door and the opening when the door is in the closed position. Mounted to the wall 14 adjacent the door is keeper 16. As shown in FIG. 2, the keeper 16 is mounted on a striker plate 17 by fasteners 19. Fasteners 19 also mount striker plate 17 onto the wall 14.

Referring more particularly to FIG. 2, the door catch assembly 10 includes a housing 18. The housing includes a flat rear wall 20 which abuts the outer surface of the door and two L-shaped flanges 22. The flanges 22 are connected to the rear wall by spot welds 24. The flanges 22 have parallel portions 23 transverse to the rear wall 20. The housing is mounted to the door by fasteners 25 which extend through aligned apertures in the flanges 22 and rear wall 20.

The lever arm 26 is pivotably mounted to the housing 18. A rod 28 extends through two flanges 27 of the lever arm 26 and the two flange portions 23. The lever arm pivots about the rod 28. The rod 28 is fixed to the flanges 22.

Slots 49 are positioned at the end of the flanges opposite the rod 28. The slots have an inclined straight edge 50 which is inclined to the plate of the door at approximately 25° for illustrative purposes. Other angles, larger or smaller, in the range of 20° to 40° are also suitable. The slots 49 also have an arcuate edge 52. A portion 52*a* of the arcuate edge 52 is substantially parallel to the plane of the door. A second portion 52*b* of the arcuate edge is more transverse to the plane of the door.

Figure 4:
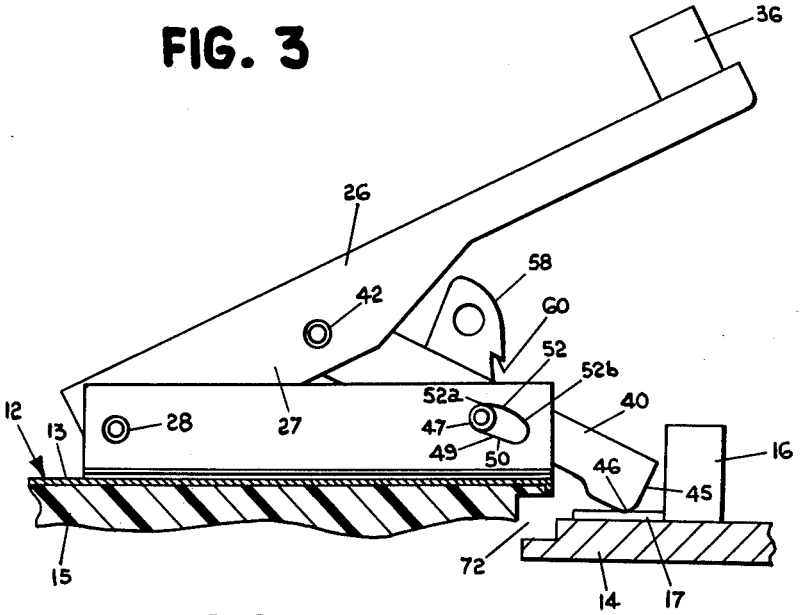
FIG. 4 is side elevational view of the door catch assembly shown in FIG. 1 in an open position.
Figure 6:
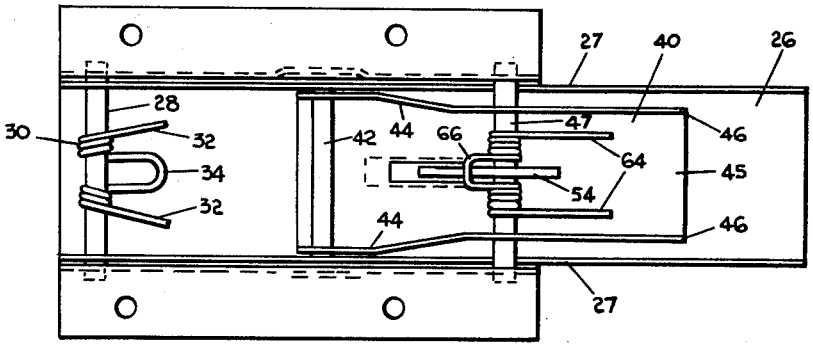
FIG. 6 is a back elevational view of the door catch assembly taken along the lines 6—6 of FIG. 3.

As shown in FIGS. 3 and 6, a spring 30 is mounted on rod 28. The spring has extensions 32 which abut the rear wall 20 and loop 34 which abuts the lever arm for biasing the lever arm to an open position as shown in FIG. 4. The lever arm 26 extends over the edge of the housing and over the keeper 16. The lever arm 26 has a rubber bumper 36 connected at the extended end. At a midportion of the lever is a slot 38.

Referring now to FIGS. 3, 4, and 6, a shank 40 is pivotably mounted to the lever arm 26. A rod 42 extends through apertures in flanges 44 of the shank 40 and through the flanges 27 of the lever arm 26. The rod 42 is fixedly welded to the lever arm while the shank 40 is free to pivot about the rod 42. As shown in FIG. 3, an end portion 45 of shank 40 engages keeper 16. Lever arm 26 extends over keeper 16 and is spaced apart from it. As shown in FIG. 4, flanges 44 of shank 40 extend downwardly to engage the striker plate 17.

A guide rod 47 extends through flanges 44 of shank 40. Guide rod 47 is fixedly welded to the shank 40. As shown in FIGS. 3 and 4, guide rod 47 extends through slots 49 in flanges 22.

Figure 5:
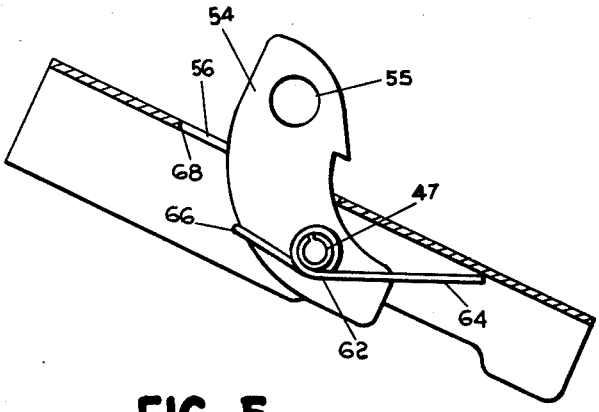
FIG. 5 is a fragmentary view showing the latch and shank portion of the door catch assembly shown in FIG. 1.

Referring now to FIGS. 5 and 6, a latch 54 is mounted on guide rod 47. The latch extends through slot 56 into shank 40 and slot 38 in lever arm 26. The latch has an upper camming surface 58 and a hook portion 60 as shown in FIG. 4 which engages the edge of slot 38. Latch 54 has an aperture 55 adapted to receive a padlock (not shown).

A spring 62 is mounted on guide rod 47 and has extensions 64 abutting the shank 40 and loop portion 66 abutting the latch 54. Latch 54 is biased to the engagement position with lever arm 26.

As shown in FIG. 2, edge 68 of slot 56 is laterally positioned closer to latch 54 than edge 70 of slot 38.

In operation, the latch is normally in the closed position as shown in FIG. 3 with the shank end 45 engaging the keeper. The hook portion 60 of latch 54 retains the spring biased lever 26 in the closed position. When it is desired for the door to be opened, the operator presses against latch 54 to release hook 60 from lever arm 26. Spring 30 forces lever arm 26 to the open position. Rod 42 fixed to the lever arm 26 follows it outward and pulls the shank to a corresponding open position as shown in FIG. 4. When the shank is moved to the open position, guide pin 47 abuts and slides against the arcuate edge 52 of slot 49 from the position as shown in FIG. 3 to the position shown in FIG. 4. The lower edge 46 of flanges 44 of shank 40 abuts the striker plate 17 to force the door 12 to pivot away from wall 14 such that any frost buildup between the sealing surface 11 and the door 12 is broken by the separation 72 therebetween. The lever arm 26 can then be manually grabbed and pulled to completely open the door 12. Alternatively, the door may be hinged at its bottom for automatic opening due to the force of gravity.

When one desires to close the door, one merely slams it shut. Upon closing of the door, the lower edge 46 of the flanges 44 abuts the striker plate 17 to cam the shank 40 and lever arm 26 to the closed position. Upon closing, the roller pin 47 follows the arcuate edge 52 of slot 49. The parallel portion 52*a* of the edge 52 allows the roller pin to move whereby the engaging end 45 of the shank 40 at first moves toward the keeper 16 from the striker plate 17 and then as the roller pin engages the transverse section 52*b* of edge 52, pivots upward to engage the keeper 16. The closing momentum of the door causes the lever arm 26 to achieve a closed position and be latched by hook 60 of latch 54.

In this fashion, a door catch assemby is made which can automatically latch against the resilient force of the seals about the door edge. The door catch also has its lever arm pivoting in the same direction as the door such that manual grasping of the lever arm and an opening force applied to the lever arm is more effective in opening the door and breaking any frost buildup.

Reasonable variation and modification may be made to the above described embodiment without departing from the spirit and scope of the invention as defined in the appended claims.

The embodiments of the invention is which an exclusive property or privilege is claimed are defined as follows:

1. A door catch device mounted on a door comprising:

a housing mounted on the door;

a lever arm;

mounting means for pivotably mounting the lever arm to the housing for movement between a first and second position;

a shank pivotably mounted to the lever arm at a distance apart from the mounting means mounting the lever arm to the housing;

guide means for guiding the pivotably mounted shank to a first and second position when the lever arm is in a corresponding first and second position;

a keeper mounted adjacent the door for engagement with the shank when in the first position;

biasing means for biasing the shank and lever arm to their respective second positions when the shank and lever arm are in the respective first positions; and a latch pivotably mounted on the shank for coupling with the lever arm when the shank and lever arm are in their respective first positions and for retaining the shank and lever arm in the first positions; the latch being disengageable from the lever arm when moved to allow the biasing means to move the lever arm and shank to the second position.

2. A door catch device as defined in claim 1 wherein the guide means comprises:

the housing having flanges defining planes transverse to the plane defined by the door;

slots extending through the flanges; and a cylindroid pin mounted on the shank and extending through the slots, the cylindroid pin movable between a first and second position in the slots corresponding to the first and second position of the shank and lever arm.

3. A door catch device as defined in claim 2 wherein the latch is mounted on the cylindroid pin of the guide means.

4. A door catch as defined in claim 3 wherein the latch extends through a slot in the shank and an aligned slot through the lever arm, the latch is spring biased to engage the lever arm.

5. A door catch device as defined in claim 4 and further comprising a camming means formed on the latch for automatically engaging the lever arm when moved from a second to the first position.

6. A door catch device as defined in claim 5 and further comprising means for preventing the latch from disaligning with the slot through the lever arm such that the lever arm is free to move from the second to first position.

7. A door catch device as defined in claim 1 further comprising a striker plate mounted adjacent the door; and camming means on the shank for engaging the striker plate to urge the shank and lever arm from the second to the first position.

8. A door catch device as defined in claim 1 wherein the lever arm extends beyond an edge of the door and the lever is aligned over the shank and keeper.

9. A door catch device mounted on a door comprising:

a housing mounted on the door;

a lever arm;

mounting means for pivotably mounting the lever arm to the housing for movement between a first and second position;

a shank pivotably mounted to the lever arm at a distance from the mounting means mounting the lever arm to the housing;

a guide means connecting the shank to the housing for guiding the pivotably mounted shank to a corresponding first and second position when the lever arm is in the first or second position, the guide means comprising:

arcuate track means defining an arc in a plane transverse to the plane defined by the door, the arc having a transverse portion and parallel portion with respect to the plane defined by the door, the parallel portion being farther from the door than the transverse portion;

a track insert means mounted to the shank for movement in the arcuate track means when the shank is moved between the first and second positions, the track insert in engagement with the transverse portion when the shank and lever arm are in or near the first position and the track insert in engagement with the parallel section when the shank and lever arm are in or near the second position;

a keeper mounted adjacent the door for engagement with the shank when in the first position;

biasing means for biasing the shank and lever arm to the second position;

a latch connected to the housing for engagement with the lever arm when the lever arm is in the first position and capable of disengagement from the lever arm to allow the biasing means to move the lever arm to the second position.

10. A door catch as defined in claim 9 further comprising two outwardly extending flanges from the housing wherein:

the lever arm and shank fit between the flanges, the arcuate track means are slots located in the flanges and have an outer arcuate edge;

the track insert is a cylindroid pin mounted on the shank and extending through the slots.

11. A door catch as defined in claim 10 wherein the inner edges of the slots are inclined to the plane defined by the door between an angle between 20° and 40° and are sloped toward the door and keeper.

12. A door catch as defined in claim 10 wherein the latch is mounted on the cylindroid pin.

13. A door catch as defined in claim 12 wherein the latch extends through a slot in the shank and an aligned slot through the lever arm, the latch is spring biased to engage the lever arm.

14. A door catch device as defined in claim 13 and further comprising a camming means formed on the latch for automatically engaging the lever arm when moved from a second to first position.

15. A door catch device as defined in claim 14 and further comprising means for preventing the latch from misaligning with the slot through the lever arm such that the lever arm is free to move from the second to first position.

* * * * *